United States Patent [19]

Liebermann

[11] Patent Number: 4,791,979

[45] Date of Patent: Dec. 20, 1988

[54] GAS ASSISTED NOZZLE FOR CASTING METALLIC STRIP DIRECTLY FROM THE MELT

[75] Inventor: Howard H. Liebermann, Succasunna, N.J.

[73] Assignee: Allied-Signal Inc., Morris Township, Morris County, N.J.

[21] Appl. No.: 166,738

[22] Filed: Mar. 2, 1988

Related U.S. Application Data

[63] Continuation of Ser. No. 888,099, Jul. 18, 1986, abandoned, which is a continuation of Ser. No. 682,734, Dec. 17, 1984, abandoned.

[51] Int. Cl.[4] ..... B22D 11/06

[52] U.S. Cl. ..... 164/463; 164/423; 164/429; 164/479; 164/415; 164/475

[58] Field of Search ..... 164/423, 463, 429, 479, 164/475, 415

[56] References Cited

U.S. PATENT DOCUMENTS 4,262,734 4/1981 Liebermann ..... 164/423

FOREIGN PATENT DOCUMENTS 622725 4/1981 Switzerland ..... 164/463

*Primary Examiner*—Kuang Y. Lin

*Attorney, Agent, or Firm*—Gus T. Hampilos

[57] ABSTRACT

A method and apparatus for casting rapidly solidified metallic strip includes a nozzle mechanism which has an orifice for directing a stream of molten metal onto a movable quench surface. An upstream constraint mechanism constrains an upstream portion of a melt puddle formed on the quench surface by molten metal from the molten metal stream. A side constraint mechanism constrains two, opposite side portions of the melt puddle, and a downstream constraint mechanism provides a selected gas pressure, constraining force against a downstream, top surface of the melt puddled.

12 Claims, 4 Drawing Sheets

GAS ASSISTED NOZZLE FOR CASTING METALLIC STRIP DIRECTLY FROM THE MELT

This application is a continuation of application Ser. No. 888,099, filed July 18, 1986, which is a continuation of application Ser. No. 682,734, filed Dec. 17, 1984, both now abandoned.

BACKGROUND OF THE INVENTION

1. Field of the Invention

The present invention relates to an apparatus and method for casting metallic strip directly from tee melt. More particularly, the invention relates to an apparatus and method for casting rapidly solidified metal strip which has improved surface quality.

2. Brief Description of the Prior Art

U.S. Pat. No. 4,221,457 to Narasimhan discloses a method and apparatus for casting amorphous metal strip which includes a slotted nozzle that has lips spaced from a moving chill surface to support a melt puddle. U.S. Pat. 4,274,473 to Bedell, et al. discloses a casting nozzle which has a first lip and a second lip. The first lip is located closer to a chill surface than the second lip. U.S. Pat. No. 4,290,476 to Smith, et al. discloses a casting nozzle which has a first lip, a second lip and two side edges. The first lip and the two side edges are closer to a chill surface than the second lip. U.S. Pat. No. 3,863,700 to Bedell, et al. discloses a method and apparatus for producing metal filament by a melt extraction technique. A discrete amount of molten metal is elevated from a melt by a gas jet directed against the surface of the melt. The elevated molten metal is forced up into contact with a quench wheel by the gas jet.

Conventional casting devices and techniques, however, have had several shortcomings. The device taught by Bedell, et al. ('700), for example, has not been able to reliably produce continuous strip having uniform thickness and width. Devices and techniques, such as those taught by Narasimhan, Smith, et al. and Bedell, et al. ('473) have been susceptible to clogging of the nozzle orifice, and are particularly sensitive to the surface finish of the downstream supporting lip. As a result, conventional devices have produced non-uniform strip and have produced strip with undesirable markings and striations on the strip surface.

SUMMARY OF THE INVENTION

The present invention provides an apparatus and method for casting metallic strip having improved surface quality. Generally stated, the apparatus of the invention includes a nozzle means which has an orifice for directing a stream of molten metal onto a movable quench surface. An upstream constraint means constrains an upstream portion of a melt puddle formed on the quench surface by molten metal from the molten metal stream. Side constraint means constrain two, opposite side portions of the melt puddle and a downstream constraint means provides a selected gas pressure, constraining force against a downstream, top surface of the molten metal puddle.

The present invention further provides a method for casting metallic strip, which includes the step of directing a stream of molten metal onto a movable quench surface to form a molten metal, melt puddle thereon. An upstream portion of the melt puddle and two, opposite side portions of the melt puddle are constrained, and a selected constraining gas pressure force is directed against a downstream, top surface of the melt puddle.

The method and apparatus of the invention advantageously improve the surface quality of the cast strip. The device and technique of the present invention reduces "splash marks" on the surface of the cast strip and reduces striations on the strip top surface caused by contact of the melt against a downstream lip of a casting nozzle. In addition, the gas pressure force provided by the invention can effectively meter the molten metal flow from the nozzle orifice. This metering effect allows the use of wider slot orifices, measured in the direction of chill surface movement, and reduces the likelihood of clogging in the nozzle slot. In addition, the metering effect can be employed to reduce the flow rate of molten metal from a relatively wide nozzle slot when casting very thin strip. Where the pressuring force of the invention is provided by a reducing gas, the method and apparatus of the present invention can reduce undesired oxidation of the molten metal and the cast strip. Where the pressuring gas composition includes a reactive gas, the present invention can produce a desired coating on the cast strip.

BRIEF DESCRIPTION OF THE DRAWINGS

The invention will be more fully understood and further advantages will become apparent when reference is made to the following detailed description of the preferred embodiment of the invention and the accompanying drawings in which.

DETAILED DESCRIPTION OF THE PREFERRED EMBODIMENTS AND BEST MODE FOR PRACTICE

For the purposes of the present invention, a strip is a slender body in which the transverse width and thickness dimensions are much smaller than its length. Thus, the term strip includes wire, ribbon, sheet and the like, having regular o irregular cross-section. Also, for the purposes of the present invention, the various directions are referenced with respect to the direction of chill surface movement. In particular, the upstream direction is the direction opposite to the direction of chill surface movement, measured from the casting nozzle orifice.

The downstream direction is the direction which is the same as the direction of chill surface movement, measured from the casing nozzle orifice. The normal direction is the direction perpendicular (normal) to the local plane of the chill surface measured approximately at the nozzle orifice location. The transverse direction is the direction perpendicular to both the normal direction and the direction of the chill surface movement, and corresponds approximately to the width direction of the cast strip.

Figure 1:
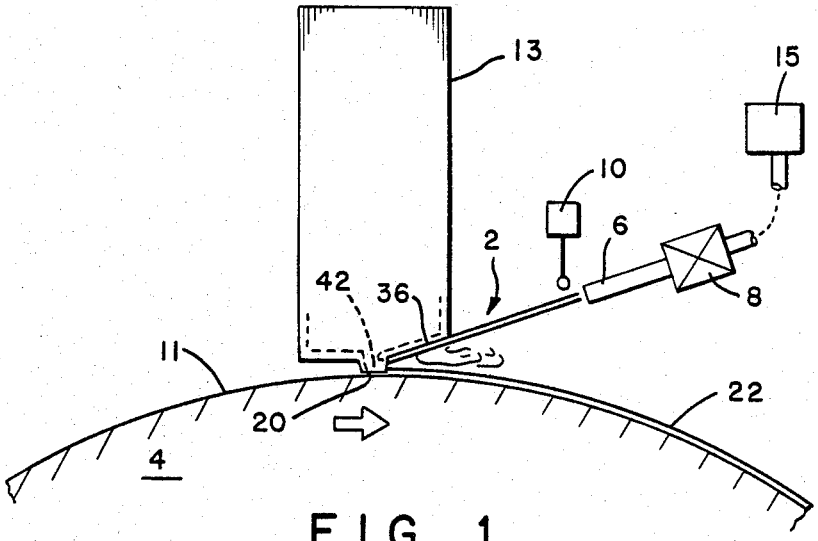
FIG. 1 shows a schematic representation of an apparatus of the invention which employs a gas jet to exert a constraining force on a melt puddle.
Figure 2:
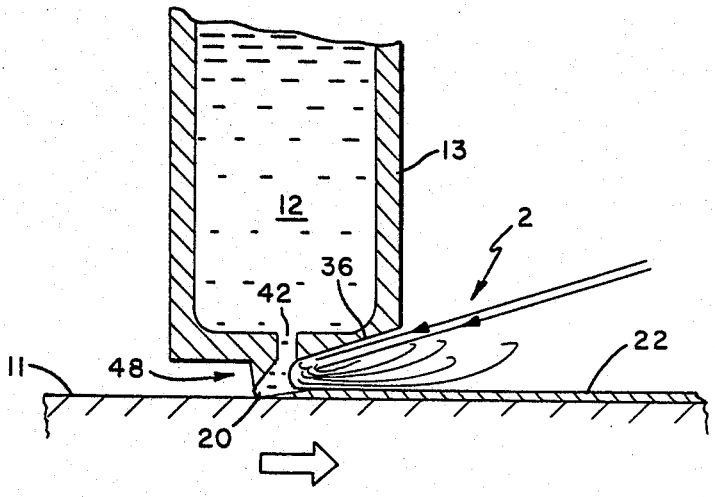
FIG. 2 representatively shows a cross-sectional close up view of the apparatus shown in FIG. 1.

FIGS. 1 and 2 schematically show an apparatus of the invention in which a casting nozzle means 13 contains molten metal 12 and has an orifice 42 in a nozzle outlet portion 48. The nozzle orifice deposits molten metal onto quench surface 11 of a movable chill body, such as rotatable casting wheel 4, to form cast strip 22. Alternatively, the chill body can be provided by an endless casting belt (not shown). Gas supply 15 supplies a suitable gas under pressure to gas nozzle 6, which forms a jet 2 of moving gas. Control valve 8 regulates the gas flow through the gas nozzle. Casting nozzle 13 has a downstream, outer portion 36 which is suitably contoured to allow gas jet 2 to impinge directly against a downstream, top surface of melt puddle 20 formed by molten metal 12 on quench surface 11.

Figure 3:
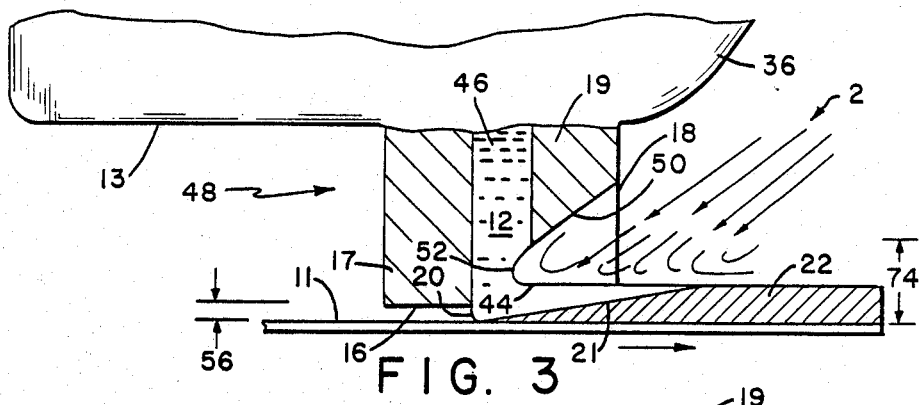
FIG. 3 representatively shows a particular nozzle outlet configuration.
Figure 4:
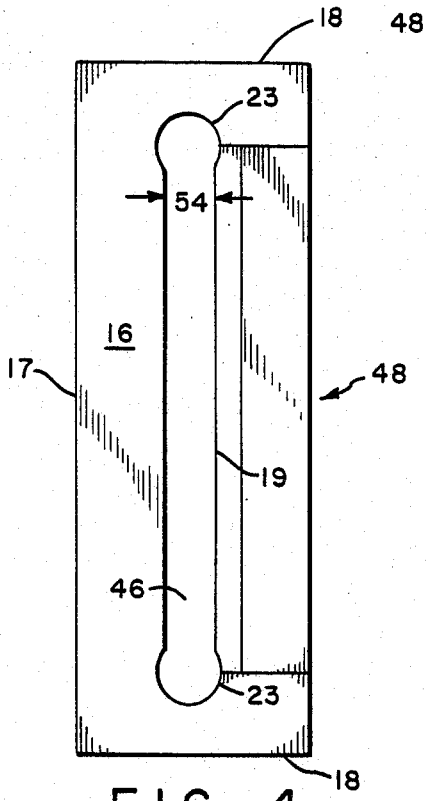
FIG. 4 representatively shows a bottom plan view of the nozzle outlet shown in FIG. 3.
Figure 6:
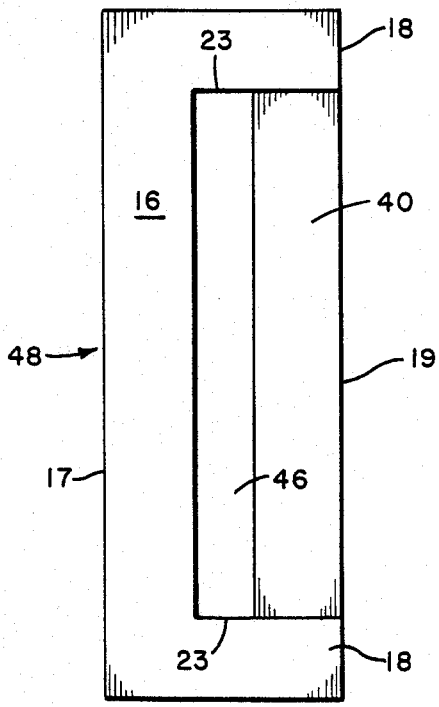
FIG. 6 representatively shows a bottom plan view of the nozzle outlet configuration shown in FIG. 5.

As representatively shown in FIGS. 3 and 4, casting nozzle 13 has an outlet portion 48 which includes an upstream constraining means, such as upstream wall member 17, for constraining an upstream portion of melt puddle 20. A side constraining means, such as the two sidewall members 18, constrain two, opposite side portions of melt puddle 20. A downstream constraining means, such as gas jet 2, provides a selected gas pressure constraining force against a downstream top surface 44 of melt puddle 20. In a particular aspect of the invention, casting nozzle 13 includes a slot-type orifice oriented substantially transverse to the casting direction. The casting direction is the direction of chill surface movement indicated generally by the arrow. Nozzle outlet 48 has a downstream member 19 which is contoured at a downstream surface portion 50 to allow a substantially free impingement of gas jet 2 against the top surface 44 of melt puddle 20.

Figure 5:
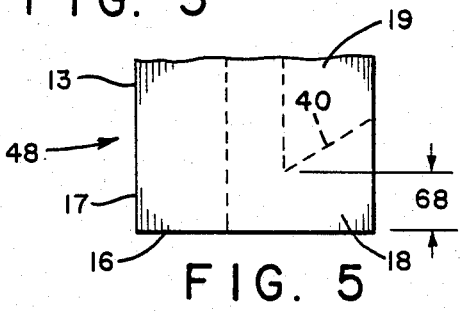
FIG. 5 representatively shows a side elevational view of another nozzle outlet configuration of the invention.

Upstream wall member 17 connects to nozzle 13 adjacent to an upstream side of orifice 46 and is oriented in the transverse direction. Downstream member 19 connects to nozzle 13 adjacent to a downstream side of orifice 46, and is oriented in the transverse direction, substantially parallel to upstream wall member 17. Two sidewall members 18 each connect to nozzle 13 adjacent to opposing, transversely located side portions of orifice 46. Sidewall members 18 extend downstream from upstream wall members 17 at least as far as the downstream member and are oriented substantially parallel to each other. Upstream wall member 17 and side wall members 18 extend downward, along the normal direction, closer to quench surface 11 than downstream member 19, and are positioned with a casting gap 56, measured between quench surface 11 and bottom surface 16 of the nozzle outlet, which ranges from about 0.02 to 1 mm. In a preferred aspect of the invention, the casting gap ranges from about 0.02 to 0.3 mm. The difference 68 (FIG. 5) between the downward extending lengths of upstream wall member 17 and downstream outlet member 19 ranges from about 0 to 1 mm.

When casting nozzle 13 has a slot-type orifice 46, gas jet 2 is configured as a flat, generally planar jet of moving gas directed against melt puddle 20. Whatever the jet configuration, gas jet 2 has a gas velocity which ranges from about 0.1 to 15 m/sec. This velocity produces a stagnation pressure, $P_s$, within the range of about 0.1 to 200 kPa according to the formula $P_s = \frac{1}{2}\rho v^2$, wherein $\rho$ is the gas density at the melt puddle and v is the gas velocity at the puddle. This gas pressure provides a constraining force against top surface 44 of melt puddle 20 which supports the top of the puddle and allows casting of a substantially uniform strip 22.

In conventional rapid solidification casting devices, the downstream top surface of the melt puddle is generally supported by a downstream lip member, such as the lip member taught by U.S. Pat. No. 4,221,457 to Narasimhan. Any imperfections on the downstream lip member, however, can cause undesired marks or striations on the top surface of the cast strip. These marks and striations undesirably degrade the strip quality. In addition, when casting a molten metal alloy which has a low viscosity of less than about 0.01 Pascal-sec. (Pa-sec), undesirable "splash" marks can form on the top surface of strip 22.

The gas pressure constraining force provided by the present invention, however, advantageously removes melt puddle 20 from direct contact with a rigid supporting lip member, and provides support with a resilient pressurizing force exerted by a fluid gas. If desired, the gas can be a reactive gas that forms a selected coating or skin on the cast strip. Preferably, this gas is a nonreactive gas, such as argon or nitrogen, which reduces oxidation of the melt and the cast strip. In one aspect of the invention, the gas includes a reducing gas, such as carbon monoxide (CO). In a particularly preferred aspect of the invention, the pressurizing gas is a reducing gas flame which consumes and removes oxygen from the region of melt puddle 20 in an exothermic combustion reaction. For example, with reference to FIG. 1, a suitable mixture of CO with ambient air is ignited by igniter 10 to produce a gas jet 2 composed of a reducing flame which impinges against melt puddle 20 and exerts a selected constraining against the top surface of the melt puddle.

The gas-assisted nozzle o the invention distinctively utilizes the gas pressure to shape the melt stream above the downstream portion of the molten alloy puddle in the casting gap (between the nozzle downstream member 19 and the moving substrate surface 11). In addition to isolating the melt flow from a downstream nozzle lip member, the apparatus and technique of the invention constrains and shapes the downstream portion 52 of the melt stream exiting nozzle orifice 42, and smooths the top surface of the melt puddle.

If the surface energy of a liquid is given by $\gamma_L$, then the gas pressure, P, required to shape the liquid to an inverse radius of curvature, R, can be calculated from the equation:

$$P = \gamma_L \left( \frac{1}{2R} + \frac{1}{(\delta - t)} \right),$$

assuming that the molten alloy does not wet the nozzle. In this equation, $\delta$ represents the casting gap and t represents the strip thickness. Since the magnitude of the liquid surface tension varies with the alloy composition and temperature, the gas pressure required for satisfactory operation will depend significantly on these two variables. As a general rule, low melting temperature metals will have low surface energy in the molten state, and will require a relatively low gas pressuring force against melt puddle 20.

As representatively shown in FIG. 3, gas jet 2 also provides a regulating means for metering the flow of molten metal 12 from orifice 46. As gas jet 2 impinges against the molten metal exiting from the orifice, the jet constrains and reduces the effective orifice opening, and restricts the outflow of molten metal 12. An appropriate adjustment of the constraining force exerted by jet 2, for example by adjusting the velocity of the gas stream, can regulate the molten metal flow and help adjust the thickness dimension of cast strip 22, as measured in the normal direction. As a result, the orifice width 54 (FIG. 4), measured in the direction of the chill surface movement, can be significantly wider than the orifice widths employed in conventional rapid solidification strip casting devices. Similarly, the present invention allows the use of conventional nozzle widths when casting very thin strips that measure less than about 15 micrometers in thickness, as-cast. The orifice width can range from about 0.1 to 20 mm. This increased orifice width advantageously reduces the likelihood of nozzle clogging.

Figure 7:
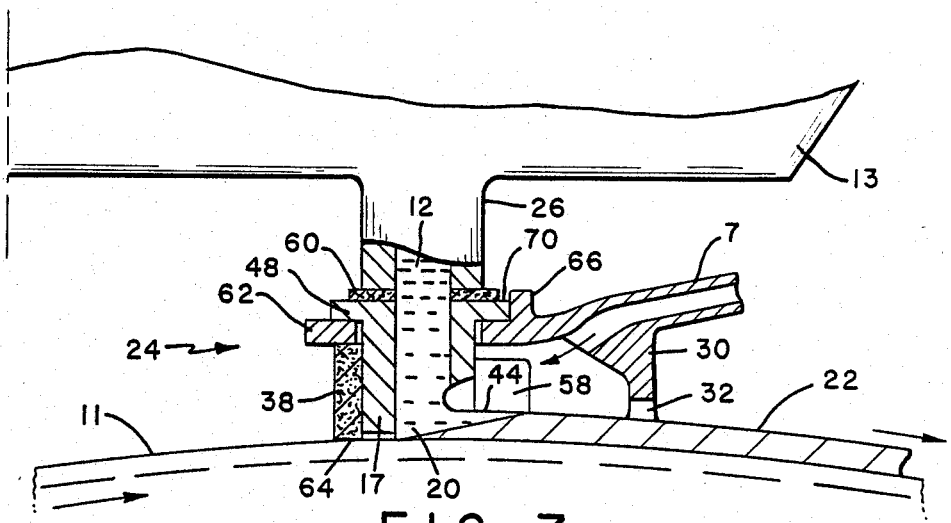
FIG. 7 representatively shows an apparatus of the invention which includes a localized chamber disposed around the region of the nozzle orifice.
Figure 8:
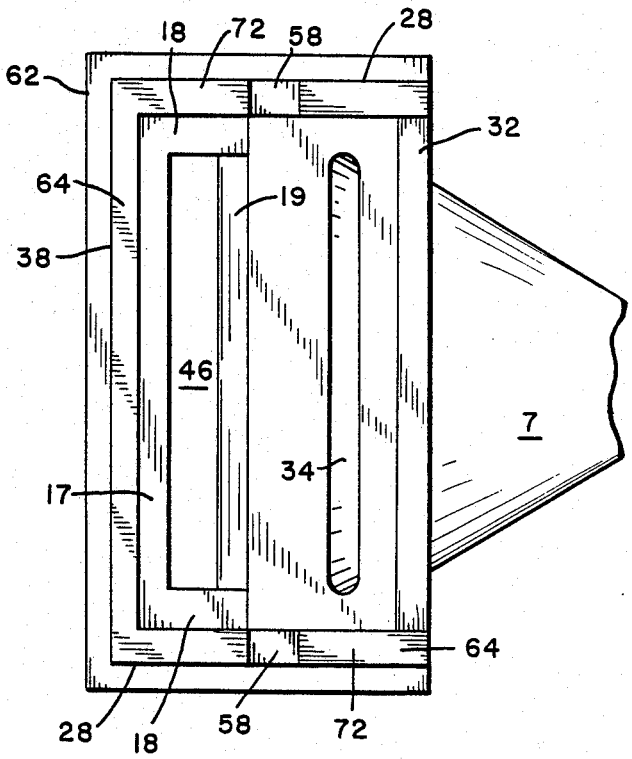
FIG. 8 representatively shows a bottom plan view of the device shown in FIG. 7.

FIGS. 7 and 8 representatively show a localized chamber 24 located around the region of the nozzle orifice 46. The localized chamber includes an upstream chamber wall 38 which is connected to the nozzle upstream wall member 17 and arranged substantially transverse to the direction of movement of quench surface 11. Two side, chamber walls 28 are each connected to extend downstream from opposite end portions of upstream chamber wall 38. Exiting means comprised of opening 32 exits cast strip 22 from chamber 24. A gas supplying means comprised of gas conduit 7 and inlet opening 34 is directed into localized chamber 24 and provides a selected gas pressure within the chamber which is above an ambient pressure measured upstream from nozzle 13. This gas pressure provides the desired constraining force against the top surface of melt puddle 20.

FIG. 7 also representatively shows an embodiment of the invention in which nozzle outlet portion 48 is detachable from nozzle 13. In this configuration, nozzle 13 has an extension 26, and a resilient sealing means, such as a resilient gasket 60 composed of a ceramic felt is interposed between nozzle extension 26 and nozzle outlet portion 48. A top member 62 of chamber 24 contacts a flange portion 70 of nozzle outlet 48 to urge outlet portion 48 against gasket 60. Nozzle outlet 48 extends downward through an opening in top member 62. Upstream chamber wall 38 connects to top member 62 and extends downward therefrom to slidingly contact quench surface 11 at surface 64. Side chamber walls 28 connect to upstream chamber wall 38 and extend downstream therefrom. Side chamber walls 28 also connect to chamber top member 62 and extend downward therefrom into a sliding contact with quench surface 11 at sliding surfaces 72. Vent openings 58 through side chamber walls 28 vent excess gas out to the ambient atmosphere.

Upstream chamber wall 38 and side chamber walls 28 are constructed from a suitable heat resistant material such as a ceramic felt impregnated with colloidal graphite. The material contacting against quench surface 11 should be wear resistant and should have low coefficient of friction. An example of a suitable material is FIBERFRAX ceramic felt (manufactured by Carborundum Company) which has been impregnated with a colloidal graphite material, such as GRAPHKOTE-220 (manufactured by Joseph Dixon Crucible Co., Jersey City, N.J.). In addition, the bottom surfaces 72 of side chamber walls 28 should be suitably contoured to substantially match the contour of quench surface 11.

The embodiment of the invention representatively shown in FIGS. 7 and 8 advantageously provides a nozzle outlet portion which is readily detached and reassembled to nozzle body 13. In addition, the particular configuration of upstream chamber wall 38 and side chamber walls 28 provide means for accurately locating nozzle upstream wall member 17 and nozzle side wall members 18 at a selected gp distance above quench surface 11. Since upstream chamber walls 38 and side chamber walls 28 slidably contact quench surface 11, localized chamber 24 and nozzle outlet 48 can accurately follow any variations in the contour of quench surface 11. As a result, the thickness dimension of strip 22 will be more uniform. The resilience of gasket 60 allows slight up and downward movements of chamber 24 and nozzle outlet 48 while maintaining a substantially leak-free seal between outlet 48 and nozzle extension 26.

EXAMPLE

Copper-base brazing foil was cast on a chill wheel with and without a gas pressuring force directed against the top surface of the melt puddle. The nozzle had a slot orifice which measured 0.38 mm wide and 25.4 mm long. The upstream gap 56 between nozzle wall member 17 and quench surface 11 measured 0.051 mm, and the downstream gap 74 between downstream nozzle member 19 and the quench surface measured 0.10 mm. During casting, the chill wheel rotated at a rotational speed that provided a peripheral velocity of 20 m/sec at quench surface 11, and the nozzle outlet was located away from the wheel top-dead-center position by about 2.54 mm in the downstream direction. The molten copper alloy was cast at a temperature of about 1423K and a casting pressure of about 58 kPa. The gas jet nozzle 6 was spatula shaped and had an outlet jet opening which measured approximately 0.51 mm wide and 50.8 mm long. Gas was supplied to the jet nozzle at a pressure of about 680 kPa and a flow rate of about 5000 cc/sec.

Figure 9:
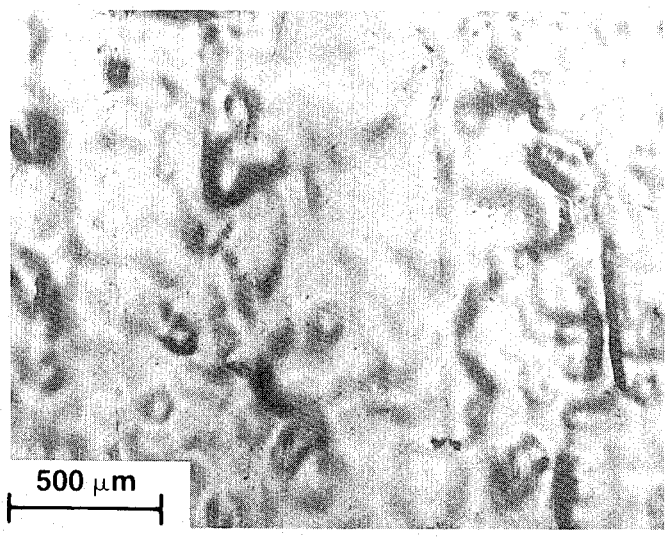
FIG. 9 is a photograph which representatively shows the top surface of a strip that was cast employing a conventional technique.
Figure 10:
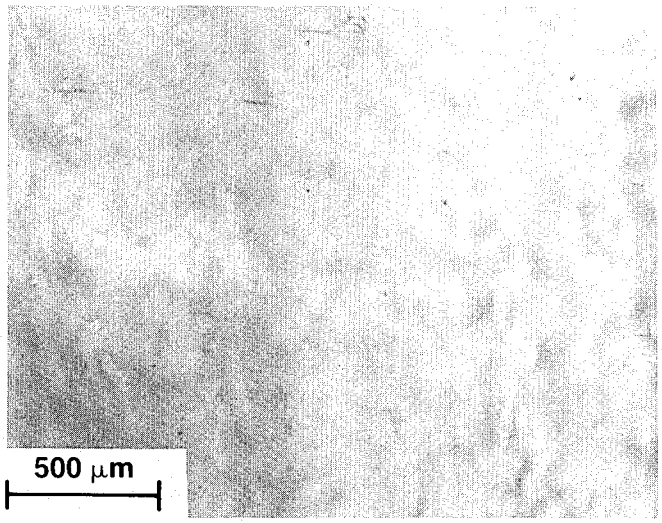
FIG. 10 is a photograph which representatively shows the top surface of a strip that was cast employing a gas pressuring force directed against the melt puddle.

When foil was cast without a pressuring force from the gas jet, the top surface of the cast strip was excessively wavy, as representatively shown in FIG. 9 by the prominent, dark contrast markings. When foil was cast with the gas jet producing a suitable pressuring force, the waviness of the top surface of the cast strip was significantly reduced. As can be seen in FIG. 10, the darkness of the contrast markings, which is caused by the relative differences between the peaks and valleys of the waves on the strip surface, has been reduced.

Having thus described the invention in rather full detail, it should be understood that these details need not be strictly adhered to but that various changes and modifications may suggest themselves to one skilled in the art, all falling within the scope of the invention as defined by the subjoined claims.

I claim:

1. A method for casting metallic strip, said method comprising the steps of:

(a) directing a stream of molten metal from an orifice of a nozzle onto a movable quench surface to form a melt puddle, said stream being defined by an upstream surface and a downstream surface, in the direction of movement of said quench surface, and opposed side surfaces;

(b) constraining the upstream and opposed side surfaces of said stream, with surfaces associated with the nozzle, to control at least a portion of the shape of the melt puddle;

(c) metering molten metal flow from the orifice by constraining with gas pressure the downstream surface of the molten metal stream; and (d) solidifying metal from said melt puddle to produce a metallic strip.

2. The method of claim 1 wherein the gas pressure is supplied by a gas jet impacting said downstream surface at a velocity ranging from about 0.1 to 15 m/sec.

3. The method of claim 2, wherein said gas jet is comprised of a reducing gas.

4. The method of claim 2 wherein the gas jet is comprised of carbon monoxide.

5. The method of claim 2, wherein the gas jet is a combusting gas.

6. The method of claim 2, wherein the gas jet exerts a constraining gas pressure which is about 0.1 to 200 kPa above an ambient pressure measured upstream from said nozzle.

7. An apparatus for casting metallic strip, said apparatus comprising:

(a) a movable quench surface for deposition thereon of molten metal for solidification into a strip;

(b) a nozzle arranged relative to said quench surface and having an orifice defined therein for directing a stream of molten metal onto said quench surface, said nozzle comprising an upstream constraint surface for constraining an upstream portion of the molten metal stream to be deposited on said quench surface, and side constraint surfaces for constraining two, opposed side portions of molten metal stream to be deposited on said quench surface; and, (c) gas pressuring means arranged opposite said upstream constraint means for supplying gas under pressure to effect metering of molten metal flow from the orifice.

8. An apparatus as recited in claim 7, wherein said quench surface is defined by a surface of a movable casting belt.

9. An apparatus as recited in claim 7, wherein said quench surface is defined by a surface of a rotable casting wheel.

10. An apparatus as recited in claim 7, wherein said orifice is a slot-type orifice.

11. An apparatus for casting metallic strip, said apparatus comprising:

(a) a movable quench surface for deposition thereon of molten metal for solidification onto a strip;

(b) a nozzle arranged relative to said quench surface and having an orifice defined therein for directing a stream of molten metal onto said quench surface;

(c) a wall member associated with said nozzle adjacent an upstream portion of said orifice for constraining an upstream portion of the molten metal to be deposited on said quench surface;

(d) side wall members associated with said nozzle means adjacent side portions of said orifice for constraining side portions of the molten metal to be deposited on said quench surface; and (e) gas pressuring means arranged opposite said upstream wall member for supplying gas under pressure to effect metering of molten metal flow from the orifice.

12. An apparatus as defined in claim 7, wherein said upstream constraint means includes a surface arranged at a distance about 0.02 to about 1 mm from said quench surface, and wherein said side constraint means each include a surface arranged at a distance about 0.02 to about 1 mm from said quench surface.

* * * * *